United States Patent [19]

Suzuki

[11] 4,329,414

[45] May 11, 1982

[54] ELECTROPHOTOGRAPHIC PROCESS

[75] Inventor: Yoshiro Suzuki, Hachioji, Japan

[73] Assignee: Olympus Optical Company Limited, Tokyo, Japan

[21] Appl. No.: 172,847

[22] Filed: Jul. 24, 1980

Related U.S. Application Data

[63] Continuation of Ser. No. 936,936, Aug. 25, 1978, abandoned.

[30] Foreign Application Priority Data

Sep. 1, 1977 [JP] Japan ..... 52/104157

[51] Int. Cl.[3] ..... G03G 13/09; G03G 13/16; G03G 13/22

[52] U.S. Cl. ..... 430/103; 118/651; 118/657; 118/658; 430/122; 430/126

[58] Field of Search ..... 118/647, 657, 658, 651; 430/103, 122, 126

[56] References Cited

U.S. PATENT DOCUMENTS

| | | | |
|---|---|---|---|
| 3,355,289 | 11/1967 | Hall et al. | 430/126 |
| 3,592,166 | 7/1971 | Wu | 118/649 |
| 3,627,523 | 12/1971 | Shelffo | 430/98 |
| 3,950,089 | 4/1976 | Fraser et al. | 355/3 DD |
| 3,996,892 | 12/1976 | Parker et al. | 118/658 |
| 4,076,857 | 2/1978 | Kasper et al. | 430/103 |
| 4,081,571 | 3/1978 | Nushihama et al. | 430/120 |

OTHER PUBLICATIONS

Hawley, G. G., *The Condensed Chemical Dictionary,* New York, Van Nostrand Reinhold Co., 1977, p. 699.

*Primary Examiner*—Evan K. Lawrence
*Attorney, Agent, or Firm*—Fleit & Jacobson

[57] ABSTRACT

An electrophotographic duplicating process suitable for high humidity conditions utilizes a magnetic brush developing device having an electrically conductive development electrode with an electrically insulating coating thereon in conjunction with a developer. The developer consists of toners with a volume resistivity higher than $10^{13}\Omega\cdot$cm. and magnetic carriers with a volume resistivity of about $10^5$ to $10^8\Omega\cdot$cm and has a toner concentration varying from about 7% to about 13% by weight. Once formed, an electrostatic charge latent image is repeatedly developed and transferred to an image receiving member to form at least twenty duplicated copies.

4 Claims, 6 Drawing Figures

ELECTROPHOTOGRAPHIC PROCESS

This is a continuation of application Ser. No. 936,936, filed Aug. 25, 1978, abandoned.

BACKGROUND OF THE INVENTION

The invention relates to an electrophotographic process and particularly to an electrophotographic process for forming a plurality of duplicated copies having the same image by repeating development and transfer steps successively for an electrostatic charge latent image once formed on an electrostatic charge retentive member.

Such an electrophotographic process has been known and described in Japanese Patent Application Publication Nos. 7,789/71 and 17,298/74. In the former publication there is disclosed a technique for avoiding a discharge phenomena which might be produced when a record paper is separate from a photosensitive member after a latent image has been developed with toner particles by means of a cascade development method and the toner image has been transferred to the record paper by means of an electrostatic transfer step with using a corona charger. In the later publication there is described a method for reducing a decay in potential of the electrostatic charge latent image by applying a magnet brush development method with the aid of magnetic carriers having coated with an electrically insulating surface layer. In these known processes since an edge effect is liable to appear during the development step it is necessary to arrange an electrically conductive development electrode in proximity of the latent image and in order to avoid an overdevelopment of the base or background in the image it is necessary to apply a development bias voltage to the development electrode. Therefore during the development the electrostatic charge forming the latent image escapes or leaks by means of the developer particles and the development electrode so that the potential of the latent image is decreased and thus it is impossible to print a number of copies of high quality from the single and same charge latent image. Particularly in a high humidity condition the development particles become damp and thus the potential of the latent image might be decreased to a greater extent. Further in case of using the magnetic carriers having insulating surface it is quite difficult to make such carriers having the high resistance and the mechanical strength of the insulating coats is rather low. Therefore the potential of the electrostatic charge latent image could not be sufficiently maintained articularly in the high humidity condition.

SUMMARY OF THE INVENTION

The present invention has for its object to provide an electrophotographic process in which the decrease in potential of the electrostatic charge latent image through the developing particles and development electrode can be avoided in a simple and positive manner so as to form a number of duplicated copies of high quality by repeating the development and transfer steps for the same and single electrostatic charge latent image once formed on an electrostatic charge retentive member.

An electrophotographic process according to the invention comprises a step for forming an electrostatic charge latent image corresponding to an image of a document to be duplicated on an electrostatic charge retentive member; a step for developing said latent image by bringing it in contact with a magnetic brush of developer particles including toners and magnetic carriers formed by magnet means on an electrically insulating member arranged between the charge retentive member and an electrically conductive development electrode to which a development bias voltage is applied; a step for transferring the developed toner image onto an image receiving member; and a step for repeating said development and transfer steps successively for the electrostatic charge latent image once formed on the charge retentive member to form a plurality of duplicated copies.

In a preferred embodiment according to the invention, the developer has a toner concentration of at least about 7% by weight.

DESCRIPTION OF THE PREFERRED EMBODIMENTS

Figure 1:
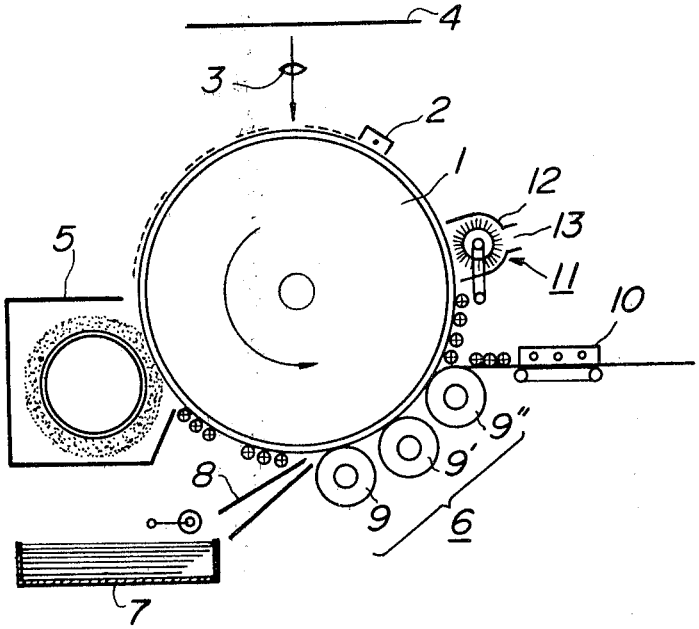
FIG. 1 is a diagrammatic view showing schematically a whole construction of an electrophotographic apparatus which can print a plurality of duplicated copies by repeating development and transfer steps successively for a single and same electrostatic charge latent image.

FIG. 1 is a schematic view showing a whole construction of an electrophotographic apparatus in which a plurality of duplicated copies are formed from the same and single electrostatic charge latent image once formed on a charge retentive member by repeating development and transfer steps successively. The apparatus comprises a rotating electrostatic charge retentive member 1 including an electrically conductive substrate, a photoconductive-sensitive layer applied on the substrate and composed of inorganic photoconductive material such as Se, SeTe, CdS, etc. or organic photoconductive material, and an electrically insulating layer or a photoconductive layer such as a PVK layer applied on the photosensitive layer. Hereinafter the electrostatic charge retentive member is referred as a photosensitive drum. At first the drum 1 is uniformly charged by a corona charger 2. Then an image of a document 4 to be duplicated is projected onto the uniformly charged surface of the photosensitive drum 1 by means of an optical system 3 to form on the drum 1 an electrostatic charge latent image corresponding to the image of the document 4. Next the latent image is converted into a visual image by a magnetic brush development device 5. The toner image thus developed is sent to a transfer section 6 to which is also fed a record paper 8 from a record paper cassette 7. During the paper 8 passes between the drum 1 and transfer rollers 9, 9' and 9'' the toner image is transferred to the record paper 8. The transfer rollers are formed by electrically conductive rubber rollers to which a transfer bias voltage is applied. The record paper 8 having the toner image transferred thereto is fed to a fixing device 10 in which the toner image is fixed to the paper by heating to produce a final copy.

The photosensitive drum 1 is further fed to a cleaning section 11 at which toner particles residual on the photosensitive drum 1 are removed by a cleaning brush 12 and the collected toners are discharged through a duct 13. In this manner a single duplicated copy is obtained and the drum 1 has been prepared for a next duplicating operation.

Whilst in case of forming a plurality of copies from the single and same charge latent image the cleaning section 17 is made inoperative by separating or retaining the cleaning brush 12 from the drum 1. Thus the electrostatic charge latent image still remains on the photosensitive drum 1 and is again developed with toners at the development device 5. The developed toner image is then transferred onto a new record paper 8 at the transfer section 6. By repeating the development and transfer steps successively a plurality of duplicated copies can be formed. After a given number of copies have been printed the cleaning brush 12 is made in contact with the drum 1 and residual toner particles on the drum are removed.

A problem in forming a plurality of copies from the single and same electrostatic charge latent image by effecting repeatedly the development and transfer steps in succession is an electrostatic charge retentive property of the photosensitive drum 1 which serves as a member for retaining the electrostatic charge latent image. That is to say it is desirable that the photosensitive member has a very low dark decay. For instance a photosensitive member comprising a Se layer on a conductive substrate and a PVK layer or a thin insulating layer applied on the Se layer has a very low dark decay and thus is suitable for the multi-copying application. The inventor has found experimentally that when the dark decay after three minutes is lower than about 30% with respect to an initially charged potential, it is possible to form ten and several duplicated copies, but in order to print several tens of duplicated copies the dark decay after three minutes from the initial charging should be lower than 10%. The latter property can be achieved by several photosensitive members such as a photosensitive member comprising a Se layer and a PVK layer applied on the Se layer, a photosensitive member comprising a SeTe layer and a PVK layer applied on the SeTe layer, and a photosensitive member comprising a Se or SeTe layer and a transparent insulating layer of organic material applied on the Se or SeTe layer. For instance the Se-PVK photosensitive member has a dark decay lower than several percentages.

Further during the transfer step a transfer bias voltage of relatively low value may be applied to the transfer rollers 9, 9' and 9'' to avoid the deterioration of the electrostatic charge latent image. For example, the transfer bias voltage lower than $-500$ volts may be used with taking into account the following facts, i.e. the electrostatic charge latent image might be affected if the toner image is wholly transferred, the deterioration of the latent image can be prevented by covering the latent image with highly insulating toner particles which remains on the photosensitive member; when a high transfer bias voltage is applied, electrostatic charge is injected onto the photosensitive member through the record paper to produce an overdevelopment; the last mentioned phenomenon is particularly noticeable under a high humidity condition. The inventor has also found that even if the relatively low transfer bias voltage is applied, a sufficiently useful transfer operation can be effected by using the transfer roller made of conductive rubber having a volume resistivity of $10^8 \sim 10^{11}\Omega\cdot cm$ and by arranging a plurality of transfer rollers along the travelling path of the photosensitive member.

As a record paper a so-called plain paper may be used. But in general the plain paper has the volume resistivity which fluctuates between $10^8\Omega\cdot cm$ and $10^{14}\Omega\cdot cm$ in dependence on the humidity and thus it is preferable to utilize a record paper which has been treated to have a high resistance.

Hithertofore an effort for avoiding the deterioration of the electrostatic charge latent image on the photosensitive member has been paid by adopting the above mentioned techniques. But the known process is not sufficient for printing a great number of duplicated copies of high quality from the electrostatic charge latent image once formed on the photosensitive member. For instance it has been found that the latent image might be deteriorated during the development. As mentioned above the photosensitive member comprising the Se layer, PVK layer and insulating layer has an extremely low dark decay and an amount of residual charge after exposure is relatively large, so that the over-development is liable to appear. Therefore during the development it is desired to provide a development electrode to which a development bias voltage is applied. For example, when the latent image has an imagewise dark area of $-500$ volts and an imagewise bright area of $-100$ volts, it is preferable to apply the development bias voltage of $-150$ to $-200$ volts. When use is made of the magnetic brush development device the charge forming the latent image gets away through the electrically conductive magnetic carriers and the development electrode.

In order to avoid such a decay of the charge of the latent image it has been proposed to use magnetic carriers having insulating coatings. However it is quite difficult to form such insulated magnetic carriers. Further if the developer particles are subjected to the high humidity for a relatively long time period the developer becomes damp and thus its resistance becomes lower. Therefore the deterioration of the electrostatic charge latent image could not be avoided.

The present invention is to avoid the deterioration of the electrostatic charge latent image at the development section in a simple and effective manner. To this end according to the invention an electrically conductive member serving as a development electrode is coated with an electrically insulating surface layer. In a preferred embodiment according to the invention a toner concentration is made relatively high.

Figure 2:
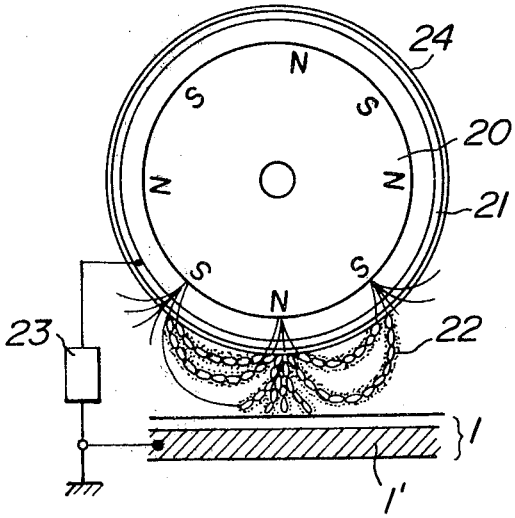
FIG. 2 is a schematic view illustrating an embodiment of a magnet brush development device for use in the process according to the invention.

FIG. 2 is a cross sectional view showing schematically an embodiment of the magnetic brush development device for use in the electrophotographic process according to the invention. The development device comprises a magnet roller 20 and an electrically conductive sleeve 21 arranged coaxially with the roller 20 and either one of them is rotated or both of them are rotated relative to each other. Due to lines of magnetic force 22 from the magnet roller 20 the developer particles including the magnetic carriers and toners applied on the carriers are formed as a brush. When the magnet roller 20 and/or the sleeve 21 rotates, the magnetic brush of the developer particles is also rotated and is made in contact with the surface of the photosensitive drum 1. In this manner the electrostatic charge latent image on the drum 1 is developed with the toner particles. During this development process the metal sleeve 21 serves as a development electrode and is connected to a development bias supply voltage source 23 which is connected to a conductive substrate 1' of the photosensitive drum 1. Thus an electric field is formed between the sleeve 21 and the substrate 1'. According to the invention an electrically insulating layer 24 is applied on the surface of the conductive sleeve 21. Therefore the electrostatic charge on the photosensitive drum 1 could not get away through the magnetic carriers to the sleeve 21 and thus the electrostatic charge latent image could not be deteriorated.

The effect of avoiding the deterioration of the latent image can be improved by using the developer having a higher volume resistivity in which the toner concentration with respect to the magnetic carriers is made high such as 5 to 13% by weight, particularly 7 to 13% by weight.

Figure 3:
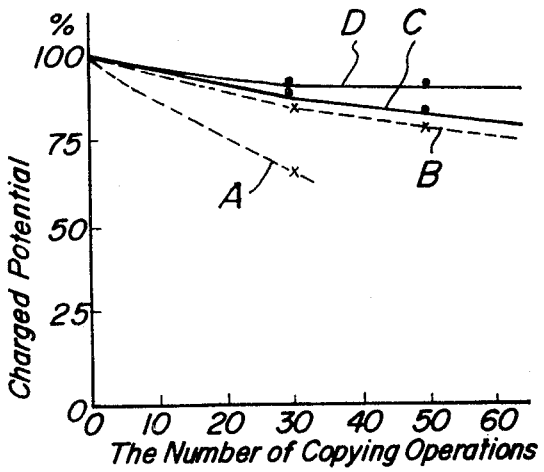
FIGS. 3 and 4 are graphs showing a deterioration of the charge latent image and a decrease of a black density of dark area in a duplicated image with comparing the process according to the invention with a known process.

FIG. 3 is a graph showing a few examples of the decay characteristic of the charged potential during the multiple duplicating operation in accordance with the process according to the invention and that of the known processes. The toner concentration of the developer is selected to be 7% by weight. An abscissa represents the number of copying operations and an ordinate represents the charged potential relative to an initially charged potential of 100%. Broken curves A and B indicate the variation of charged potential in case of the known conductive sleeve having no insulating coating under the conditions of humidity of 80% and 50%, respectively. These curves A and B show that the charged potential decreases abruptly from a smaller number of duplicated copies. On the contrary as shown by solid curves C and D the decrease of the charged potential is quite small even after sixty copying operations under the same humidity conditions of 80% and 50%, respectively.

Figure 4:
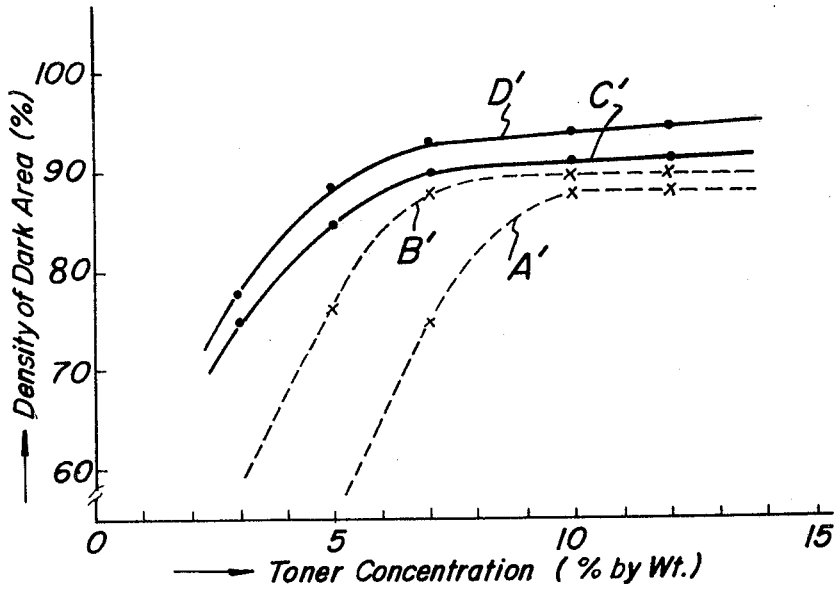

FIG. 4 is a graph showing a relationship between the toner concentration (denoted by percentage by weight) and a black density of dark area of a twentieth copy (a black density of a dark area in a first copy is represented as 100%). Broken curves A' and B' indicate the results obtained by using the known conductive sleeve having no insulating coating under the humidity conditions of 80% and 50%, respectively and solid curves C' and D' show the results obtained by effecting the duplication with the insulated sleeve according to the invention under the humidity conditions of 80% and 50%, respectively. As can be seen from the graph the decrease of the black density of dark area in the duplicated copy can be materially limited by using the sleeve having the insulating surface layer and the developer having the toner concentration higher than 5% by weight, preferably higher than 7% by weight and thus a greater number of duplicated copies can be formed from the same and single electrostatic charge latent image which has been once formed on the photosensitive member.

As described above according to the invention the deterioration of the electrostatic charge latent image during the multiple duplicating operation can be effectively obviated in such a very simple manner that the conductive development electrode is coated with the electrically insulating layer. Further when the toner concentration of the developer particles is made high, the deterioration of the latent image can be further avoided. In this case it is considered that the function of the development electrode itself might be limited by providing the insulating coat on its surface and an edge effect might appear, but in fact the effect of the development electrode could be maintained by arranging the development sleeve closer to the charge retentive member within about 3 to 5 mm and a thickness of the magnetic brush is limited to about 3 to 5 mm. The effect according to the invention could be effectively achieved by using the conductive sleeve made of aluminum and the insulating coat is formed by an aluminum oxide layer formed by oxidation and having a thickness of 10 to 30 μm or use may be made of a thin layer of high molecular material such as a "Mylar" (trade name for polyethylene terephthalate). Further it is preferable to use the developer including magnetic carriers made of iron oxide powders which have a relatively high conductivity in the order of $10^5$ to $10^8\Omega\cdot$cm and toner particles which have a volume resistivity higher than about $10^{13}\Omega\cdot$cm.

Figure 5:
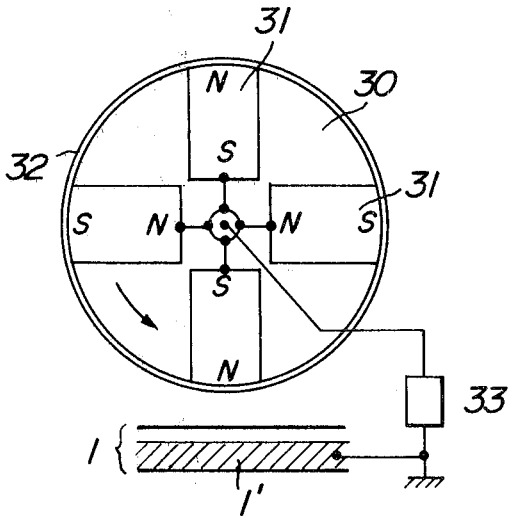
FIGS. 5 and 6 are schematic views showing another embodiments of the magnetic brush developing device for use in the process according to the invention.

FIG. 5 is a cross section illustrating another embodiment of the magnet brush development device for use in the process according to the invention. In this embodiment a magnet roller comprises a body 30 of non-magnetizable and insulating material, magnets 31 embedded in the body 30 and an electrically insulating layer 32 applied on the outer surface of the roller. In this construction the magnets 31 also serve as a development electrode and are connected to a development bias voltage source 33 which is connected to an electrically conductive substrate 1' of a photosensitive drum 1.

Figure 6:
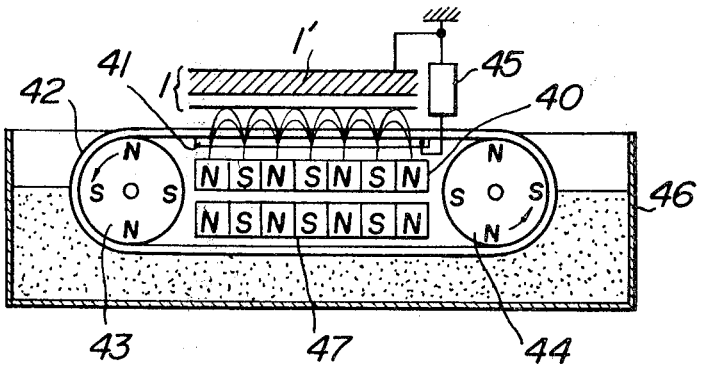

FIG. 6 is a cross section showing still another embodiment of the magnetic brush development device for use in the electrophotographic process according to the invention. In the present embodiment magnets 40 and a development electrode 41 are fixedly arranged and an endless belt 42 made of electrically insulating and non-magnetizable material is arranged between a pair of magnet rollers 43 and 44. The belt 42 travels between the development electrode 41 and a photosensitive drum 1. A development bias voltage source 45 is connected across the development electrode 41 and a conductive substrate 1' of the photosensitive drum 1. Developer particles are contained in a vessel 46 and are transported on the belt 42 by means of a magnetic force of the magnet roller 44. Under the magnets 40 are arranged second magnets 47 for stirring the developer particles in the vessel 46. According to this embodiment the insulating belt 42 can effectively prevent the electrostatic charge latent image from being deteriorated through the developer particles and the development electrode.

The present invention is not limited to the embodiments explained above, but many modifications can be conceived by those skilled in the art within the scope of the invention.

What is claimed is:

1. An electrophotographic process comprising the steps of: introducing into a magnetic brush developing device including an electrically conductive development electrode and magnet means arranged inside the development electrode, a developer consisting of toners with a volume resistivity higher than $10^{13}\Omega\cdot$cm and magnetic carriers with a volume resistivity of about $10^5$ to $10^8\Omega\cdot$cm and having a toner concentration varying from about 7% by weight to about 13% by weight; applying a development bias voltage to said electrically conductive development electrode having applied thereon an electrically insulating coat formed by an aluminum oxide layer of a thickness of 10 to 30 μm with sufficiently high resistivity for preventing any electrostatic charge from being transferred through the magnetic carriers with respect to an electrostatic charge retentive member under a high humidity condition; forming an electrostatic charge latent image corresponding to an image of a document to be duplicated on the electrostatic charge retentive member; developing said electrostatic charge latent image by bringing it in contact with a magnetic brush formed by said toners and magnetic carriers on said electrically insulating coat; transferring the developed toner image onto an image receiving member; and repeating said development and transfer steps successively for the electrostatic charge latent image once formed on said electrostatic charge retentive member to form at least twenty duplicated copies.

2. An electrophotographic process comprising the steps of: introducing into a magnetic brush developing device including an electrically conductive development electrode and magnet means arranged inside the development electrode, a developer consisting of toners with a volume resistivity higher than $10^{13}\Omega\cdot$cm and magnetic carriers with a volume resistivity of about $10^5$ to $10^8\Omega\cdot$cm and having a toner concentration varying from about 7% by weight to about 13% by weight; applying a development bias voltage to said electrically conductive development electrode; providing an electrically insulating member between said electrically conductive development electrode and an electrostatic charge retentive member, said electrically insulating member being formed by a thin layer of high molecular material such as polyethylene terephthalate with sufficiently high resistivity for preventing any electrostatic charge from being transferred through the magnetic carriers with respect to said electrostatic charge retentive member under a high humidity condition; forming an electrostatic charge latent image corresponding to an image of a document to be duplicated on the electrostatic charge retentive member; developing said electrostatic charge latent image by bringing it in contact with a magnetic brush formed by said toners and magnetic carriers on said electrically insulating member; transferring the developed toner image onto an image receiving member; and repeating said development and transfer steps successively for the electrostatic charge latent image once formed on said electrostatic charge retentive member to form at least twenty duplicated copies.

3. An electrophotographic process according to any one of claims 1 and 2, wherein said toner concentration of the developer is set to a value within a range from about 10% by weight to about 13% by weight.

4. An electrophotographic process according to any one of claims 1 and 2, wherein a spacing between said charge retentive member and the electrically conductive development electrode is set to a value within a range from 3 mm to 5 mm.

* * * * *